US007390369B2

(12) United States Patent
Odaka et al.

(10) Patent No.: US 7,390,369 B2
(45) Date of Patent: Jun. 24, 2008

(54) METHOD FOR PRODUCING RARE EARTH BASED ALLOY POWDER AND METHOD FOR PRODUCING RARE EARTH BASED SINTERED MAGNET

(75) Inventors: Tomoori Odaka, Ibaraki (JP); Yuji Kaneko, Uji (JP)

(73) Assignee: Neomax Co., Ltd., Osaka (JP)

( * ) Notice: Subject to any disclaimer, the term of this patent is extended or adjusted under 35 U.S.C. 154(b) by 284 days.

(21) Appl. No.: 10/553,968

(22) PCT Filed: Apr. 21, 2004

(86) PCT No.: PCT/JP2004/005731

§ 371 (c)(1),
(2), (4) Date: Oct. 19, 2005

(87) PCT Pub. No.: WO2004/094090

PCT Pub. Date: Nov. 4, 2004

(65) Prior Publication Data

US 2006/0272450 A1 Dec. 7, 2006

(30) Foreign Application Priority Data

Apr. 22, 2003 (JP) ..... 2003-117134

(51) Int. Cl.
*H01F 1/057* (2006.01)

(52) U.S. Cl. ..... 148/101; 148/103; 148/302

(58) Field of Classification Search ..... None
See application file for complete search history.

(56) References Cited

U.S. PATENT DOCUMENTS 4,770,723 A 9/1988 Sagawa et al.
4,792,368 A 12/1988 Sagawa et al.
5,595,608 A * 1/1997 Takebuchi et al. ..... 148/104
5,666,635 A 9/1997 Kaneko et al.

(Continued)

FOREIGN PATENT DOCUMENTS

JP 58-182802 10/1983

(Continued)

*Primary Examiner*—John P. Sheehan
(74) *Attorney, Agent, or Firm*—Nixon Peabody LLP; Jeffrey L. Costellia

(57) ABSTRACT

An inventive method of making a rare-earth alloy powder is used to produce a rare-earth sintered magnet, whose main phase has a composition $R_2T_{14}A$ (where R is one of the rare-earth elements including Y; T is Fe with or without a non-Fe transition metal; and A is boron with or without carbon). The method includes the steps of: preparing a first rare-earth rapidly solidified alloy, having a columnar texture with an average dendritic width within a first range, by subjecting a melt of a first rare-earth alloy with a first composition to a rapid cooling process; preparing a second rare-earth rapidly solidified alloy, having a columnar texture with an average dendritic width smaller than that of the first rare-earth rapidly solidified alloy and falling within a second range, by subjecting a melt of a second rare-earth alloy with a second composition to the rapid cooling process; making a first rare-earth alloy powder by pulverizing the first solidified alloy; making a second rare-earth alloy powder by pulverizing the second solidified alloy; and making a powder blend including the first and second rare-earth alloy powders.

14 Claims, 1 Drawing Sheet

U.S. PATENT DOCUMENTS 5,690,752 A * 11/1997 Yamamoto et al. ..... 148/302
6,676,773 B2 1/2004 Kaneko et al.

FOREIGN PATENT DOCUMENTS

JP 63-093841 4/1988
JP 63-317643 12/1988
JP 07-197182 8/1995
JP 10-172850 6/1998
JP 10-189319 7/1998
JP 2000-219942 8/2000
JP 2000-219943 8/2000

* cited by examiner

SURFACE CONTACTED WITH A ROLLER

50μm

COLUMNAR TEXTURE

CHILLED TEXTURE

SURFACE CONTACTED WITH A ROLLER

50μm

METHOD FOR PRODUCING RARE EARTH BASED ALLOY POWDER AND METHOD FOR PRODUCING RARE EARTH BASED SINTERED MAGNET

TECHNICAL FIELD

The present invention relates to a method for producing a rare-earth sintered magnet (more particularly, an R—Fe—B based sintered magnet) and also relates to a method of making a rare-earth alloy powder for use to produce such a rare-earth sintered magnet.

BACKGROUND ART

A rare-earth alloy sintered magnet (permanent magnet) is normally produced by compacting a powder of a rare-earth alloy, sintering the resultant powder compact and then subjecting the sintered body to an aging treatment if necessary. Permanent magnets currently used extensively in various applications include rare-earth-cobalt based (typically samarium-cobalt based) magnets and rare-earth-iron-boron based (typically neodymium-iron-boron based) magnets. Among other things, the rare-earth-iron-boron based magnets (which will be referred to herein as "R—Fe—B based magnets", where R is one of the rare-earth elements including Y, Fe is iron, and B is boron) are used more and more often in various electronic appliances. This is because an R—Fe—B based magnet exhibits a maximum energy product, which is higher than any of various other types of magnets, and yet is relatively inexpensive.

An R—Fe—B based sintered magnet includes a main phase consisting essentially of a tetragonal $R_2Fe_{14}B$ compound (which will be sometimes referred to herein as an "$R_2Fe_{14}B$ type crystal layer"), an R-rich phase including Nd, for example, and a B-rich phase. In the R—Fe—B based sintered magnet, a portion of Fe may be replaced with a transition metal such as Co or Ni and a portion of B may be replaced with C. An R—Fe—B based sintered magnet, to which the present invention is applicable effectively, is described in U.S. Pat. Nos. 4,770,723 and 4,792,368, for example, the entire contents of which are hereby incorporated by reference.

In the prior art, an R—Fe—B based alloy has been prepared as a material for such a magnet by an ingot casting process. In an ingot casting process, normally, rare-earth metal, electrolytic iron and ferroboron alloy as respective start materials are melted by an induction heating process, and then the melt obtained in this manner is cooled relatively slowly in a casting mold, thereby preparing a solid alloy (i.e., alloy ingot). A method for obtaining a solid alloy by a Ca reduction process (which is also called a "reduction diffusion process") is also known.

Recently, a rapid cooling process (which is also called a "melt-quenching process") such as a strip casting process or a centrifugal casting process has attracted much attention in the art. In a rapid cooling process, a molten alloy is brought into contact with, and relatively rapidly cooled by, a single chill roller, a twin chill roller, a rotating disk or the inner surface of a rotating cylindrical casting mold, thereby making a solidified alloy, which is thinner than an alloy ingot, from the molten alloy.

A solid alloy obtained by a rapid cooling process will be referred to herein as a "rapidly cooled alloy (or rapidly solidified alloy)" so as to be easily distinguished from a solid alloy obtained by a conventional ingot casting process or Ca reduction process. The rapidly solidified alloy typically has the shape of a flake or a ribbon (thin strip).

Compared to a solid alloy made by the conventional ingot casting process or die casting process (such an alloy will be referred to herein as an "ingot alloy"), the rapidly solidified alloy has been quenched in a shorter time (i.e., at a cooling rate of $10^{2\circ}$ C./sec to $10^{4\circ}$ C./sec). Accordingly, the rapidly solidified alloy has a finer texture and a smaller crystal grain size. In addition, in the rapidly solidified alloy, the grain boundary thereof has a greater area and the R-rich phases are dispersed broadly and thinly over the grain boundary. Thus, the rapidly solidified alloy also excels in the dispersiveness of the R-rich phases. Because the rapidly solidified alloy has these advantageous features, a magnet with excellent magnetic properties can be made from the rapidly solidified alloy.

An alloy powder to be compacted is obtained by coarsely pulverizing a rapidly solidified alloy in any of these forms by a hydrogen pulverization process, for example, and/or any of various mechanical grinding processes (e.g., using a ball mill or attritor) and finely pulverizing the resultant coarse powder (with a mean particle size of 10 μm to 500 μm) by a dry pulverization process using a jet mill, for example. The alloy powder to be compacted preferably has a mean particle size of 1 μm to 10 μm, more preferably 1.5 μm to 7 μm, to achieve sufficient magnetic properties. It should be noted that the "mean particle size" of a powder refers herein to an FSSS particle size unless otherwise stated.

A rapidly solidified alloy powder obtained in this manner is typically processed into compacts by a uniaxial compacting process. Due to its manufacturing method, the rapidly solidified alloy powder has a narrow particle size distribution and achieves a bad fill density (i.e., cannot fill the cavity to a desired fill density), which are both problems.

Thus, to improve the fill density of the rapidly solidified alloy powder, various countermeasures have been proposed. For example, Japanese Patent Application Laid-Open Publication No. 2000-219942 describes that if a rapidly solidified alloy, including 1 vol % to 30 vol % of chilled texture with particle sizes of 3 μm or less, is made by a roller rapid cooling process and then pulverized to obtain a rapidly solidified alloy powder, then the fill density can be increased and the sintering temperature can be decreased compared with conventional ones.

It should be noted that the "chilled texture" is a crystalline phase to be formed near the surface of a chill roller during an initial stage in which a melt of an R—Fe—B based rare-earth alloy has just contacted with the surface of a cooling member (e.g., the chill roller) of a rapid cooling system and started to solidify. Compared with a columnar texture (or dendrite texture) to be formed on and after that initial stage of the cooling and solidification process, the chilled texture has a more isotropic (or isometric) and finer structure. That is to say, the chilled texture is produced when the melt is rapidly cooled and solidified on the surface of the roller.

DISCLOSURE OF INVENTION

However, the chilled texture has a magnetically isotropic fine structure. Accordingly, if a powder of a rapidly solidified alloy includes a lot of chilled texture, then the magnetic properties of the resultant sintered magnet deteriorate.

In order to overcome the problems described above, primary objects of the present invention are to provide a method of making a rare-earth rapidly solidified alloy powder, which includes substantially no chilled texture but achieves a higher fill density than a conventional one, and also provide a method for producing a rare-earth sintered magnet by using such a powder.

A method of making a rare-earth alloy powder according to the present invention is used to produce a rare-earth sintered magnet, of which a main phase has a composition represented by $R_2T_{14}A$ (where R is one of the rare-earth elements including Y; T is either Fe alone or a mixture of Fe and a transition metal element other than Fe; and A is either boron alone or a mixture of boron and carbon). The method includes the steps of: preparing a first rare-earth rapidly solidified alloy, which has a columnar texture with an average dendritic width falling within a first range, by subjecting a melt of a first rare-earth alloy with a first composition to a rapid cooling process; preparing a second rare-earth rapidly solidified alloy, which has a columnar texture with an average dendritic width that is smaller than that of the first rare-earth rapidly solidified alloy and that falls within a second range, by subjecting a melt of a second rare-earth alloy with a second composition to the rapid cooling process; making a first rare-earth alloy powder by pulverizing the first rare-earth rapidly solidified alloy; making a second rare-earth alloy powder by pulverizing the second rare-earth rapidly solidified alloy; and making a powder blend including the first and second rare-earth alloy powders, whereby the objects described above are achieved.

In one embodiment, the first range is equal to or greater than the mean particle size of the first rare-earth alloy powder, and the second range- is less than the mean particle size of the second rare-earth alloy powder.

The first range is preferably from 3 μm through 6 μm while the second range is preferably from 1.5 μm through 2.5 μm.

A method of making a rare-earth alloy powder according to another embodiment includes the steps of: obtaining a first rare-earth alloy coarse powder by coarsely pulverizing the first rare-earth rapidly solidified alloy; obtaining a second rare-earth alloy coarse powder by coarsely pulverizing the second rare-earth rapidly solidified alloy; making a blended coarse powder by blending the first and second rare-earth alloy coarse powders together; and obtaining the powder blend having a mean particle size of 1 μm to 10 μm by finely pulverizing the blended powder.

A method of making a rare-earth alloy powder according to another embodiment includes the steps of: making a first rare-earth powder having a mean particle size of 1 μm to 10 μm from the first rare-earth rapidly solidified alloy; making a second rare-earth powder having a mean particle size of 1 μm to 10 μm from the second rare-earth rapidly solidified alloy; and obtaining the powder blend by blending the first and second rare-earth powders together.

The first and second rare-earth alloy powders included in the powder blend preferably have a volume percentage ratio of 95:5 through 60:40, more preferably 80:20 through 70:30.

In another embodiment, the second rare-earth rapidly solidified alloy is made by a strip casting process.

In another embodiment, the first rare-earth rapidly solidified alloy is made by a strip casting process.

In another embodiment, the first rare-earth rapidly solidified alloy is made by a centrifugal casting process.

In another embodiment, the first rare-earth rapidly solidified alloy includes 30 mass % to 32 mass % of R. In another embodiment, the second rare-earth rapidly solidified alloy includes 33.5 mass % to 35 mass % of R.

A rare-earth sintered magnet producing method according to the present invention is a method for producing a rare-earth sintered magnet, of which a main phase has a composition represented by $R_2T_{14}A$ (where R is one of the rare-earth elements including Y; T is either Fe alone or a mixture of Fe and a transition metal element other than Fe; and A is either boron alone or a mixture of boron and carbon). The method includes the steps of: preparing a rare-earth alloy powder by one of the methods described above; compacting a powder material, including the rare-earth alloy powder, thereby obtaining a compact; and sintering the compact, whereby the object described above are achieved.

BEST MODE FOR CARRYING OUT THE INVENTION

Hereinafter, preferred embodiments of a method for producing an R—Fe—B based rare-earth sintered magnet according to the present invention will be described with reference to the accompanying drawings.

In this description, the composition of the main phase of an R—Fe—B based sintered magnet is represented by a general formula $R_2T_{14}A$. This main phase has an $R_2T_{14}A$ type ($Nd_2Fe_{14}B$ type) crystal structure (tetragonal).

In this formula, R is one of the rare-earth elements (including Y), T is either Fe alone or a mixture of Fe and at least one transition metal element other than Fe, and A is either boron alone or a mixture of boron and carbon. It should be noted that the rare-earth element R preferably includes at least one light rare-earth element such as Nd or Pr and preferably further includes at least one heavy rare-earth element selected from the group consisting of Dy, Ho and Tb to ensure good coercivity. The light rare-earth element preferably accounts for 50 atomic % or more of the overall rare-earth element R. Examples of the non-Fe transition metal elements include Ti, V, Cr, Mn, Fe, Co and Ni. T preferably either consists essentially of Fe alone or consists mostly of Fe, a portion of which is replaced with at least one of Ni and Co.

To achieve good magnetic properties, the overall composition of the sintered magnet preferably includes 25 mass % to 40 mass % of R, 0.6 mass % to 1.6 mass % of A, and T and very small amounts of additives (and inevitably contained impurities) as the balance. The very small amounts of additives preferably include at least one element selected from the group consisting of Al, Cu, Ga, Cr, Mo, V, Nb and Mn. The total amount of those additives introduced is preferably at most 1 mass % of the overall magnet.

The present inventors analyzed the relationship between the powder fill density and texture of a rapidly solidified alloy from various angles to make the following discoveries, which formed the basis of the present invention.

A melt of a rare-earth alloy material having the desired composition described above is prepared and rapidly cooled and solidified to make a rapidly solidified alloy. In this process, the resultant rapidly solidified alloy may have any of various textures depending on that composition and/or specific conditions of the rapid cooling process.

Figure 2:
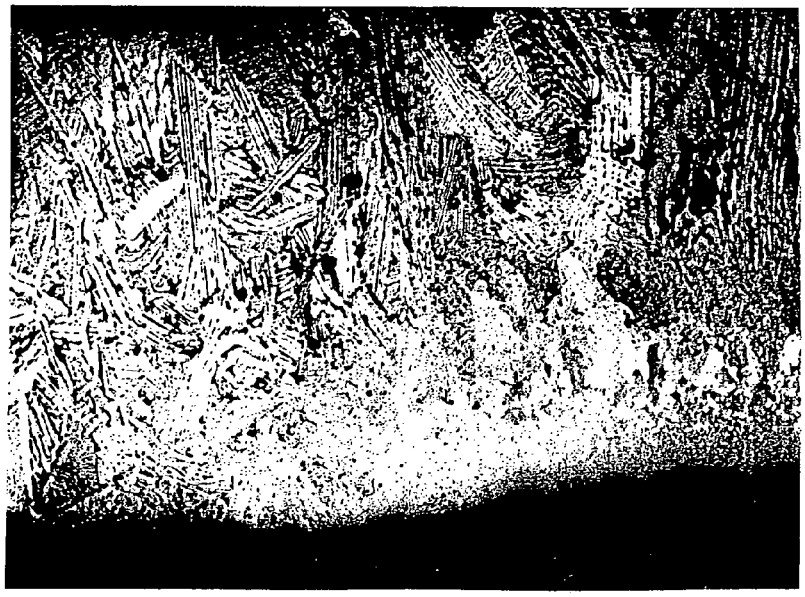
FIG. 2 is a micrograph showing a cross section of a rapidly solidified alloy including a chilled texture.

For example, in making a rapidly solidified alloy by a strip casting process (see, for example, U.S. Pat. No. 5,666,635, the entire contents of which are hereby incorporated by reference), if the circumferential velocity of the chill roller is relatively high, then a structure with a chilled texture such as that shown in FIG. 2 is formed. The cross-sectional micrograph of the rapidly solidified alloy shown in FIG. 2 includes about 10 vol % of chilled texture.

Figure 1:
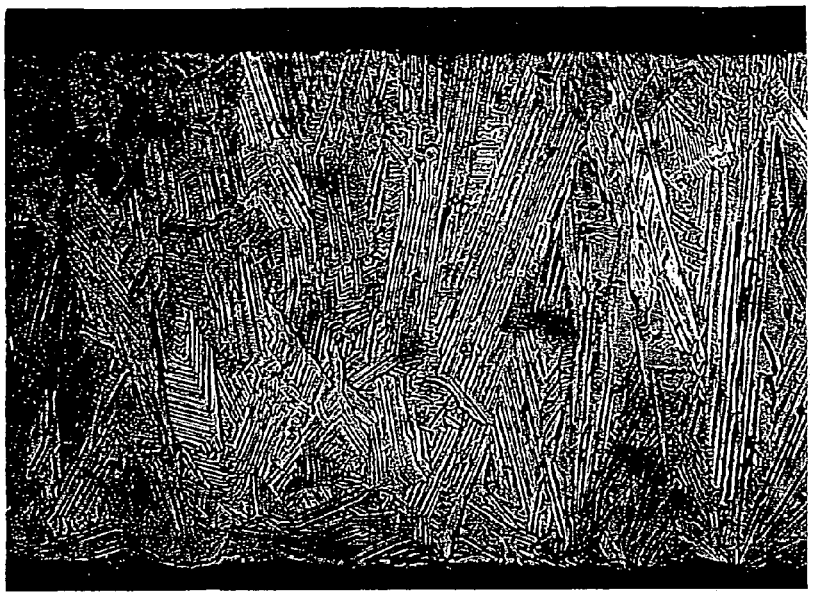
FIG. 1 is a micrograph showing a cross section of a rapidly solidified alloy including substantially no chilled texture.

On the other hand, if the circumferential velocity of the roller is relatively low, then a structure consisting essentially of a dendrite texture (i.e., columnar texture or columnar crystals) alone and including substantially no chilled texture is formed as shown in FIG. 1. Also, even if a number of structures each consist essentially of the dendrite texture, the dendritic widths thereof are changeable with the circumferential velocity of the roller. Specifically, the lower the circumferential velocity, the broader the dendritic width.

Such a difference in texture between rapidly solidified alloys also depends on the composition of the alloy. For example, when a number of alloys were compared on the same rapid cooling conditions (e.g., at the same chill roller circumferential velocity), the higher the R content of the alloy, the narrower the dendritic width thereof tended to be.

A number of rapidly solidified alloys with mutually different textures were obtained in this manner. Then, each of those alloys was subjected to pulverization, compaction and sintering process steps under predetermined conditions, thereby making a sintered magnet. The magnetic properties of the resultant sintered magnets were evaluated and the fill densities of the alloy powders that were subjected to the compaction process were estimated. As a result, the present inventors discovered that if a plurality of alloy powders, made from rapidly solidified alloys with mutually different dendritic widths, were blended and used, then the fill density of the blended alloy powder increased and the magnetic properties of the resultant sintered magnet improved. This is believed to be because if those rapidly solidified alloys with mutually different dendritic widths are pulverized, then powders with different particle size distributions corresponding to the respective dendritic widths are obtained, and therefore, the particle size distribution of the blended powder broadens. This would also be because the powder particles, made from the rapidly solidified alloys with mutually different dendritic widths, have different aspect ratios. For example, by controlling the dendritic widths of the two rapidly solidified alloys, making up the single blended powder, such that one of the two rapidly solidified alloys has an average dendritic width equal to or greater than the mean particle size thereof and that the other rapidly solidified alloy has an average dendritic width less than the mean particle size thereof, a powder, made up of two groups of particles with mutually different aspect ratios, can be obtained.

It should be noted that the dendritic width, characterizing such a rapidly solidified alloy, is supposed herein to be the average of the two different dendritic widths (which will be referred to herein as the "average dendritic width"). The average dendritic width was obtained by counting the number of dendrites included within a certain range (with a width of 20 μm to 50 μm, for example) and calculating the average. Such a method is sometimes called a "line segment method". The number of samples was supposed to be at least five.

A method of making a rare-earth alloy powder according to the present invention includes the steps of: (a) preparing a first rare-earth rapidly solidified alloy, which has a columnar texture with an average dendritic width falling within a first range, by subjecting a melt of a first rare-earth alloy with a first composition to a rapid cooling process; (b) preparing a second rare-earth rapidly solidified alloy, which has a columnar texture with an average dendritic width that is smaller than that of the first rare-earth rapidly solidified alloy and that falls within a second range, by subjecting a melt of a second rare-earth alloy with a second composition to the rapid cooling process; (c) making a first rare-earth alloy powder by pulverizing the first rare-earth rapidly solidified alloy; (d) making a second rare-earth alloy powder by pulverizing the second rare-earth rapidly solidified alloy; and making a powder blend including the first and second rare-earth alloy powders.

The first range is preferably from 3 μm through 6 μm while the second range is preferably from 1.5 μm through 2.5 μm. The reasons are as follows. Specifically, if the average dendritic width of the first rare-earth alloy powder exceeded 6 μm, then the coercivity might decrease unfavorably. However, if the average dendritic width were less than 3 μm, then the fill density might decrease, which is not beneficial, either. On the other hand, if the average dendritic width of the second rare-earth alloy powder exceeded 2.5 μm, then the fill density and/or the sinterability might decrease unfavorably. However, if the average dendritic width were less than 1.5 μm, then it would be difficult to produce a uniformly texture.

The average dendritic width of the first rare-earth alloy powder is preferably defined equal to or greater than the mean particle size thereof, but the average dendritic width of the second rare-earth alloy powder is preferably defined less than the mean particle size thereof. With these settings, the aspect ratio of particles of the first rare-earth alloy powder should be different from that of particles of the second rare-earth alloy powder, and therefore, the fill density of their blend should improve. This is particularly effective if the mean particle sizes of the first and second rare-earth alloy powders are substantially equalized with each other.

The first and second rare-earth alloy powders included in the blended powder preferably have a volume percentage ratio of 95:5 through 60:40, more preferably from 80:20 through 70:30. This is because if the blending ratio fell out of any of these ranges, the fill density could not be increased sufficiently. Optionally, not only the first and second rare-earth alloy powders but also a third rare-earth alloy powder with a different average dendritic width may be blended together.

The rapidly solidified alloys with different average dendritic widths may be obtained by changing the rapid cooling rates, for example. When a strip casting process is adopted, the rapid cooling rate may be adjusted by changing the circumferential velocity of the chill roller, for example. The strip casting process excels in mass productivity, which is very beneficial. The rapidly solidified alloy with a relatively broad dendritic width may also be made by a centrifugal casting process resulting in a relatively low rapid cooling rate.

Alternatively, the rapidly solidified alloys with different average dendritic widths may also be obtained by changing the compositions of the alloy materials. It is naturally possible to adjust both the alloy material composition and the rapid cooling rate alike. For example, when the rapidly solidified alloys are made by a strip casting process, the first rare-earth rapidly solidified alloy preferably includes 30 mass % to 32 mass % of R, while the second rare-earth rapidly solidified alloy preferably includes 33.5 mass % to 35 mass % of R. If the compositions of the first and second rare-earth alloys fell out of these ranges, then it would be difficult to obtain rapidly solidified alloys with the desired dendritic widths.

The blending process step for obtaining the blend of first and second rare-earth alloy powders, obtained from the rapidly solidified alloys with different average dendritic widths, may be carried out at an appropriate point in time. Each of the rapidly solidified alloys is typically a flake and needs to go through a two-stage pulverization process (i.e., a coarse pulverization process step and a fine pulverization process step) before the alloy powder to be subjected to the compaction process step is obtained. As to this pulverization process, the rapidly solidified alloys may be blended together at any time. That is to say, it does not matter if it is when the rapidly solidified alloys are still flakes, after the rapidly solidified alloy flakes have been coarsely pulverized into coarse powders, or after the coarse powders have been finely pulverized into fine powders (corresponding to the first and second rare-earth alloy powders described above).

Nevertheless, to minimize the oxidation of the alloy materials, not so much the fine powders as the alloy flakes or coarse powders are preferably blended together. In that case, the blending process step and the pulverization process step may be carried out at the same time. Naturally, before the blending ratio is determined, the compositions of the respective rare-earth alloy materials (in the form of alloy flakes, coarse powders or fine powders) are preferably analyzed.

The alloy powder to be eventually compacted preferably has a mean particle size of about 1 μm to about 10 μm, more preferably 1.5 μm to 7 μm. To minimize the oxidation and/or improve the flowability or compactibility, the surface of the rapidly solidified alloy powder may be coated with a lubricant if necessary. It is preferable that the lubricant is added during the process step of finely pulverizing the rapidly solidified alloy coarse powder. As the lubricant, a liquid lubricant consisting essentially of a fatty acid ester can be used effectively.

A compact is made by compacting the blended powder thus obtained by a known compaction method. Then, the compact is processed by known methods to complete a sintered magnet.

The rapidly solidified alloy powder (blended powder) may be compacted (e.g., uniaxially compacted and compacted) with a motorized press at a pressure of 1.5 ton/cm$^2$ (i.e., 150 MPa) while being aligned under a magnetic field of about 1.5 T, for example. In this process step, when the cavity of the press machine is filled with the rapidly solidified alloy powder, a fill density higher than the conventional one is achieved because the rapidly solidified alloy powder of this preferred embodiment of the present invention has excellent loadability. Accordingly, a sintered body with a predetermined density can be obtained even at a relatively low temperature. That is to say, since it is possible to prevent the crystal grains from growing excessively during the sintering process step, a sintered magnet with higher coercivity than a conventional one can be obtained.

Next, the resultant compact is sintered at a temperature of about 1,000° C. to about 1,100° C. for approximately one to five hours within either an inert gas (such as rare gas or nitrogen gas) atmosphere (preferably at a reduced pressure) or a vacuum, for example. Subsequently, by subjecting the resultant sintered body to an aging treatment at a temperature of about 450° C. to about 800° C. for approximately one to eight hours, an R—Fe—B based alloy sintered body can be obtained. Optionally, in order to reduce the amount of carbon included in the sintered body and thereby improve the magnetic properties, the lubricant that covers the surface of the alloy powder may be heated and removed if necessary before the sintering process step. This lubricant removal process step may be carried out at a temperature of about 100° C. to about 600° C. for approximately three to six hours within a reduced pressure atmosphere, although these conditions may vary with the type of the lubricant used.

Then, by magnetizing the resultant sintered body, a sintered magnet is completed. The magnetizing process step may be carried out at an arbitrary point in time after the sintering process step is over, and could be performed after the magnet has been embedded in a motor or any other device. The magnetizing magnetic field may have a strength of 2 MA/m or more, for example.

EXAMPLES

Hereinafter, a method for producing an R—Fe—B based sintered magnet according to the present invention will be described by way of specific examples. However, the present invention is in no way limited to the following specific examples.

A first rare-earth alloy may have a composition including 31.3 mass % of Nd+Pr+Dy (of which 1.2 mass % to 2.0 mass % is Dy and the rest is Nd and Pr), 1.0 mass % of B, 0.9 mass % of Co, 0.2 mass % of Al, 0.1 mass % of Cu, and Fe and inevitably contained impurities as the balance. The first rare-earth alloy with this composition was melted at about 1,350° C., and a rapidly solidified alloy (alloy flakes) was made from the resultant molten alloy by a strip casting process. By setting the circumferential velocity of the chill roller to 60 m/min, alloy flakes with a thickness of about 0.3 mm were obtained. When observing the cross section of these alloy flakes with a microscope, the present inventors confirmed that the rapidly solidified alloy included substantially no chilled texture and consisted essentially of columnar crystals alone. The average dendritic width was about 4 μm.

On the other hand, a second rare-earth alloy may have a composition including 34.5 mass % of Nd+Pr+Dy (of which 1.0 mass % to 2.0 mass % is Dy and the rest is Nd and Pr), 1.0 mass % of B, 0.9 mass % of Co, 0.2 mass % of Al, 0.1 mass % of Cu, and Fe and inevitably contained impurities as the balance. The second rare-earth alloy with this composition was melted at about 1,350° C., and a rapidly solidified alloy (alloy flakes) was made from the resultant molten alloy by a strip casting process. By setting the circumferential velocity of the chill roller to 90 m/min, alloy flakes with a thickness of about 0.2 mm were obtained. When observing the cross section of these alloy flakes with a microscope, the present inventors confirmed that the rapidly solidified alloy included substantially no chilled texture and consisted essentially of columnar crystals alone. The average dendritic width was about 2 μm.

Example No. 1

In this example, the flakes of the first and second rare-earth alloys obtained as described above were coarsely pulverized separately by a hydrogen pulverization process, for example. The resultant coarse powders were blended together with a rocking mixer. The blending ratio was 75:25 on a volume basis.

Then, the resultant blended coarse powder was finely pulverized with a jet mill to a mean particle size of about 3 μm. Optionally, before the coarse powders are blended together, those powders may be put into the jet mill by a predetermined amount so as to be blended together while being finely pulverized. Thereafter, about 0.3 mass % of a lubricant consisting essentially of a fatty acid ester was added thereto and mixed with them.

The resultant blended powder was compacted and compacted (at a pressure of 1 ton/cm$^2$ and under an aligning magnetic field of 1.5 T), thereby obtaining a compact (with dimensions of 18 mm vertically, 55 mm horizontally and 25 mm in the height (or pressing) direction). It should be noted that the aligning magnetic field was applied perpendicularly to the compacting direction. The compact thus obtained had a mass of 100 g.

Thereafter, the compact was sintered at 1,050° C. for four hours within a reduced pressure Ar atmosphere and then subjected to an aging treatment at 500° C. for one hour. Subsequently, the sintered body was magnetized with a pulse magnetizer and then the magnetic properties of the resultant sintered magnet were evaluated with a search coil and a flux meter. The fill density was measured with a tap denser. As used herein, the "fill density" refers to a tap density obtained with the tap denser. The results are shown in the following Table 1.

Example No. 2

As in the first example described above, coarse powders of the first and second rare-earth alloys were obtained. Then, the coarse powders were finely pulverized separately with a jet mill, thereby obtaining first and second rare-earth alloy powders with a mean particle size of about 3 μm. By blending these fine powders at a ratio of 75:25 using a rocking mixer, a blended powder was obtained. Thereafter, a sintered magnet was obtained and the magnetic properties thereof were evaluated as in the first example described above.

Example No. 3

A sintered magnet was produced as in the first example described above except that the first rare-earth rapidly solidified alloy was made by a centrifugal casting process. The present inventors confirmed that the first rare-earth rapidly solidified alloy, made by the centrifugal casting process, included substantially no chilled texture and consisted essentially of columnar crystals only. The average dendritic width was about 20 μm.

Comparative Example No. 1

The rare-earth alloy had a composition including 32.0 mass % of Nd+Pr+Dy (of which 1.0 mass % to 2.0 mass % was Dy and the rest was Nd and Pr), 1.0 mass % of B, 0.9 mass % of Co, 0.2 mass % of Al, 0.1 mass % of Cu, and Fe and inevitably contained impurities as the balance. The first rare-earth alloy with this composition was melted at about 1,350° C., and a rapidly solidified alloy (alloy flakes) was made from the resultant molten alloy by a strip casting process. By setting the circumferential velocity of the chill roller to 100 m/min, alloy flakes with a thickness of about 0.3 mm were obtained. When observing the cross section of these alloy flakes with a microscope, the present inventors confirmed that the rapidly solidified alloy included 10 vol % of chilled texture. Thereafter, as in the first example described above, the alloy flakes were coarsely and then finely pulverized to obtain a compact, which was then processed into a sintered magnet.

Comparative Example No. 2

A rapidly solidified alloy (alloy flakes) was made by a strip casting process from a rare-earth alloy with the same composition as the first comparative example. By setting the circumferential velocity of the chill roller to 70 m/min, alloy flakes with a thickness of about 0.3 mm were obtained. When observing the cross section of these alloy flakes with a microscope, the present inventors confirmed that the rapidly solidified alloy included substantially no chilled texture. Thereafter, as in the first example described above, the alloy flakes were coarsely and then finely pulverized to obtain a compact, which was then processed into a sintered magnet.

Comparative Example No. 3

A rapidly solidified alloy was made by a centrifugal casting process from a rare-earth alloy with the same composition as the first comparative example. When observing the cross section of this rapidly solidified alloy with a microscope, the present inventors confirmed that the rapidly solidified alloy included substantially no chilled texture but consisted essentially of columnar crystals only. The average dendritic width was about 25 μm. Thereafter, as in the first example described above, the rapidly solidified alloy was coarsely and then finely pulverized to obtain a compact, which was then processed into a sintered magnet.

TABLE 1

| | Example 1 | Example 2 | Example 3 | Comp. Ex. 1 | Comp. Ex. 2 | Comp. Ex. 3 |
|---|---|---|---|---|---|---|
| $B_r$ (T) | 1.37 | 1.37 | 1.36 | 1.34 | 1.33 | 1.33 |
| $H_{cJ}$ (kA/m) | 1233.5 | 1233.5 | 1074.3 | 1193.7 | 1114.1 | 994.8 |
| $BH_{max}$ (kJ/m$^3$) | 362 | 362 | 358 | 358 | 354 | 350 |
| Fill density (g/cm$^3$) | 2.1 | 2.2 | 2.2 | 2.0 | 2.0 | 2.0 |
| Sintering Temp. (° C.) | 1,040 | 1,040 | 1,060 | 1,050 | 1,040 | 1,080 |

As can be seen from the results shown in Table 1, the rare-earth alloy powders (blended powders) of Examples Nos. 1 to 3 achieve higher fill densities than the non-blended powders of Comparative Examples Nos. 1 to 3. Accordingly, even when sintered at relatively low sintering temperatures, the rare-earth alloy powders of Examples Nos. 1 to 3 still achieved a desired density of 7.5 g/cm$^3$ and high coercivity $H_{cJ}$.

Example No. 3 that used the first rare-earth rapidly solidified alloy (with an average dendritic width of about 20 μm) made by a centrifugal casting process did not exhibit as good magnetic properties as Examples Nos. 1 and 2 that used the first rare-earth rapidly solidified alloy (with an average dendritic width of about 4 μm) made by a strip casting process. Thus, it can be seen that the strip casting process is a preferred method for making the rapidly solidified alloy.

Next, the results of experiments the present inventors carried out to define a preferred range of average dendritic widths will be described.

With alloys having the same compositions as those described for the specific examples of the present invention used as the first and second rare-earth alloys but with the conditions of the strip casting process changed, first and second rare-earth rapidly solidified alloys with mutually different dendritic widths were obtained. The average dendritic widths of respective samples are shown in the following Table 2. After the first and second rare-earth rapidly solidified alloys were obtained in this manner, sintered magnets were produced as in the second example described above except that the sintering temperatures were set as shown in the following Table 3. The present inventors evaluated the magnetic properties of the resultant sintered magnets. The results are also shown in the following Table 3.

TABLE 2

| Sample No. | Average dendritic width of 1st rare-earth rapidly solidified alloy | Average dendritic width of 2nd rare-earth rapidly solidified alloy |
|---|---|---|
| 1 | 6 μm | 1.5 μm |
| 2 | 6 μm | 2.5 μm |
| 3 | 3 μm | 1.5 μm |
| 4 | 8 μm | 2 μm |

TABLE 3

| | Sample 1 | Sample 2 | Sample 3 | Sample 4 |
|---|---|---|---|---|
| $B_r$ (T) | 1.38 | 1.38 | 1.37 | 1.38 |
| $H_{cJ}$ (kA/m) | 1215.5 | 1215.3 | 1223.5 | 1154.0 |
| $BH_{max}$ (kJ/m$^3$) | 366 | 366 | 362 | 366 |
| Fill density (g/cm$^3$) | 2.2 | 2.2 | 2.2 | 2.2 |
| Sintering Temp. (° C.) | 1,040 | 1,040 | 1,040 | 1,050 |

As can be seen from Table 3, Sample No. 4, of which the first rare-earth rapidly solidified alloy had an average dendritic width of 8 μm, had lower coercivity $H_{cJ}$ than any other sample. Accordingly, to achieve sufficient coercivity, the first rare-earth rapidly solidified alloy preferably has an average dendritic width of 6 μm or less. It should be noted that the greater the average dendritic width of the first rare-earth rapidly solidified alloy, the higher the remanence $B_r$ tends to be and the lower the coercivity $H_{cJ}$ tends to be.

As long as the average dendritic width of the second rare-earth rapidly solidified alloy falls within the range of 1.5 μm to 2.5 μm, there is substantially no sensible difference in magnetic properties. Naturally, if the average dendritic width of the first rare-earth alloy powder were less than 3 μm and if that of the second rare-earth alloy powder exceeded 2.5 μm, then the fill density, which should be increased by blending the two types of rare-earth alloy powders together, would not increase anymore. Also, as a result of various experiments, the present inventors discovered that it was difficult to obtain a rare-earth rapidly solidified alloy with an average dendritic width of less than 1.5 μm. Thus, the minimum average dendritic width would be 1.5 μm.

Next, results of experiments, which were carried out to find the best range of the blending ratio (volume ratio) by using the same first and second rare-earth alloy powders as those of the second example, will be described. The following Table 4 shows the volume ratios of the first and second rare-earth alloy powders and the fill densities (tap densities) that were measured with a tap denser:

TABLE 4

| | Sample 5 | Sample 6 | Sample 7 | Sample 8 | Sample 9 | Sample 10 |
|---|---|---|---|---|---|---|
| Volume ratio (FIRST:SECOND) | 95:5 | 80:20 | 70:30 | 60:40 | 50:50 | 30:70 |
| Fill density (g/cm$^3$) | 2.1 | 2.2 | 2.2 | 2.1 | 1.9 | 1.8 |

where the volume ratio is the ratio of the volume of the first rare-earth alloy powder to that of the second rare-earth alloy powder.

As can be seen from the results shown in Table 4, the volume ratio of the first rare-earth alloy powder to the second rare-earth alloy powder preferably falls within the range of 95:5 to 60:40 (in particular, 80:20 to 70:30). It is not quite clear why the fill density is improved by adopting such a blending ratio. But such a volume ratio is believed to be effective in closing the gap, created by the first rare-earth alloy powder, with the second rare-earth alloy powder.

INDUSTRIAL APPLICABILITY

The present invention provides a method of making a rare-earth rapidly solidified alloy powder, which includes substantially no chilled texture but achieves a higher fill density than a conventional one, and also provides a method for producing a rare-earth sintered magnet by using such a powder.

The invention claimed is:

1. A method of making a rare-earth alloy powder for use to produce a rare-earth sintered magnet, of which a main phase has a composition represented by $R_2T_{14}A$ (where R is one of the rare-earth elements including Y; T is either Fe alone or a mixture of Fe and a transition metal element other than Fe; and A is either boron alone or a mixture of boron and carbon), the method comprising the steps of:

preparing a first R—Fe—B based rare-earth rapidly solidified alloy, which has a columnar texture with an average dendritic width falling within a first range, by subjecting a melt of a first R—Fe—B based rare-earth alloy with a first composition to a rapid cooling process;

preparing a second R—Fe—B based rare-earth rapidly solidified alloy, which has a columnar texture with an average dendritic width that is smaller than that of the first R—Fe—B based rare-earth rapidly solidified alloy and that falls within a second range, by subjecting a melt of a second R—Fe—B based rare-earth alloy with a second composition to the rapid cooling process;

making a first R—Fe—B based rare-earth alloy powder by pulverizing the first R—Fe—B based rare-earth rapidly solidified alloy;

making a second R—Fe—B based rare-earth alloy powder by pulverizing the second R—Fe—B based rare-earth rapidly solidified alloy; and making a powder blend including the first and second R—Fe—B based rare-earth alloy powders.

2. The method of claim 1, wherein the first range is equal to or greater than the mean particle size of the first R—Fe—B based rare-earth alloy powder, and the second range is less than the mean particle size of the second R—Fe—B based rare-earth alloy powder.

3. The method of claim 1, wherein the first range is from 3 μm through 6 μm.

4. The method of claim 1, wherein the second range is from 1.5 μm through 2.5 μm.

5. The method of claim 1, comprising the steps of: obtaining a first rare-earth alloy coarse powder by coarsely pulverizing the first R—Fe—B based rare-earth rapidly solidified alloy; obtaining a second rare-earth alloy coarse powder by coarsely pulverizing the second R—Fe—B based rare-earth rapidly solidified alloy; making a blended coarse powder by blending the first and second rare-earth alloy coarse powders together; and obtaining the powder blend having a mean particle size of 1 μm to 10 μm by finely pulverizing the blended powder.

6. The method of claim 1, comprising the steps of: making a first rare-earth powder having a mean particle size of 1 m to 10 μm from the first R—Fe—B based rare-earth rapidly solidified alloy; making a second rare-earth powder having a mean particle size of 1 μm to 10 μm from the second R—Fe—B based rare-earth rapidly solidified alloy; and obtaining the powder blend by blending the first and second rare-earth powders together.

7. The method of claim 1, wherein the first and second R—Fe—B based rare-earth alloy powders included in the powder blend have a volume percentage ratio of 95:5 through 60:40.

8. The method of claim 1, wherein the second R—Fe—B based rare-earth rapidly solidified alloy is made by a strip casting process.

9. The method of claim 1, wherein the first R—Fe—B based rare-earth rapidly solidified alloy is made by a strip casting process.

10. The method of claim 1, wherein the first R—Fe—B based rare-earth rapidly solidified alloy is made by a centrifugal casting process.

11. The method of claim 1, wherein the first R—Fe—B based rare-earth rapidly solidified alloy includes 30 mass % to 32 mass % of R.

12. The method of claim 1, wherein the second R—Fe—B based rare-earth rapidly solidified alloy includes 33.5 mass % to 35 mass % of R.

13. A method for producing a rare-earth sintered magnet, of which a main phase has a composition represented by $R_2T_{14}A$ (where R is one of the rare-earth elements including Y; T is either Fe alone or a mixture of Fe and a transition metal element other than Fe; and A is either boron alone or a mixture of boron and carbon), the method comprising the steps of:

preparing a R—Fe—B based rare-earth alloy powder by the method of claim 1;

compacting a powder material, including the R—Fe—B based rare-earth alloy powder, thereby obtaining a compact; and sintering the compact.

14. The method of claim 1, wherein the first and second R—Fe—B based rare-earth rapidly solidified alloys have a structure consisting essentially of a dendrite texture alone and including substantially no chilled texture.

* * * * *